US011930990B2

(12) United States Patent
Ni

(10) Patent No.: US 11,930,990 B2
(45) Date of Patent: Mar. 19, 2024

(54) VACUUM CLEANING DEVICE

(71) Applicant: Kingclean Electric Co., Ltd., Jiangsu (CN)

(72) Inventor: Zugen Ni, Jiangsu (CN)

(73) Assignee: KINGCLEAN ELECTRIC CO., LTD., Jiangsu (CN)

( * ) Notice: Subject to any disclaimer, the term of this patent is extended or adjusted under 35 U.S.C. 154(b) by 523 days.

(21) Appl. No.: 16/972,499

(22) PCT Filed: Oct. 29, 2019

(86) PCT No.: PCT/CN2019/114112
§ 371 (c)(1),
(2) Date: Dec. 4, 2020

(87) PCT Pub. No.: WO2020/155702
PCT Pub. Date: Aug. 6, 2020

(65) Prior Publication Data

US 2021/0235947 A1 Aug. 5, 2021

(30) Foreign Application Priority Data

Jan. 31, 2019 (CN) ..... 201910101314.3

(51) Int. Cl.
*A47L 9/14* (2006.01)

(52) U.S. Cl.
CPC ..... *A47L 9/1409* (2013.01); *A47L 9/1463* (2013.01); *A47L 9/149* (2013.01)

(58) Field of Classification Search
CPC ..... A47L 9/1481; A47L 9/1691
See application file for complete search history.

(56) References Cited

U.S. PATENT DOCUMENTS

2002/0166198 A1* 11/2002 McGilll ..... A47L 9/1409 15/352
2011/0056045 A1* 3/2011 Sepke ..... A47L 5/28 15/347

(Continued)

FOREIGN PATENT DOCUMENTS

CN 201968601 U 9/2011
CN 205514389 U 8/2016

(Continued)

OTHER PUBLICATIONS

European Search Report, EP Application No. 19913360.4, European Patent Office, dated Feb. 21, 2022, 14 pages.

(Continued)

*Primary Examiner* — Bryan R Muller
*Assistant Examiner* — Dana Lee Poon
(74) *Attorney, Agent, or Firm* — Quarles & Brady LLP

(57) ABSTRACT

The invention relates to a vacuum cleaning device, including a body, a dust cup, and an unlocking mechanism for unlocking and locking the dust cup. The body is provided with a vacuum cleaning channel, a filter is provided in the dust cup, the unlocking mechanism is configured to have a locking state and an unlocking state, and when the unlocking mechanism is in the locking state, the dust cup and the body are locked together in a sealing manner, and the vacuum cleaning channel is in communication with the filter and the dust cup such that the filter and the dust cup are in a working state; and when the unlocking mechanism is in the unlocking state, the dust cup and the filter are automatically disengaged from the vacuum cleaning channel to an easy-to-take state.

20 Claims, 11 Drawing Sheets

(56) References Cited

U.S. PATENT DOCUMENTS

| | | | | |
|---|---|---|---|---|
| 2018/0177365 | A1* | 6/2018 | Conrad | A47L 9/16 |
| 2019/0090701 | A1* | 3/2019 | Tonderys | A47L 9/325 |
| 2020/0022549 | A1* | 1/2020 | Bradley | A47L 9/1691 |
| 2020/0138254 | A1* | 5/2020 | Lee | A47L 9/327 |

FOREIGN PATENT DOCUMENTS

| | | | |
|---|---|---|---|
| CN | 206525993 | U | 9/2017 |
| CN | 107928544 | A | 4/2018 |
| CN | 208211971 | U | 12/2018 |
| CN | 208404394 | U | 1/2019 |
| CN | 109645881 | A | 4/2019 |
| EP | 1136028 | A2 | 9/2001 |
| EP | 1136028 | A3 | 3/2003 |
| EP | 2471427 | A2 | 7/2012 |
| EP | 2989951 | A1 | 3/2016 |
| JP | 2013-034751 | A | 2/2013 |
| JP | 2016131792 | A | 7/2016 |
| WO | WO-2012-157348 | A1 | 11/2012 |
| WO | WO-2017-207071 | A1 | 12/2017 |

OTHER PUBLICATIONS

International Search Report, on International Application No. PCT/CN2019/114112, dated Feb. 1, 2020, 6 pages, with English Translation.

* cited by examiner

VACUUM CLEANING DEVICE

CROSS REFERENCE TO RELATED APPLICATION

This application is a 371 National Phase of PCT/CN2019/114112 filed Oct. 29, 2019, by Zugen NI entitled, "Vacuum Cleaning Device" which claims priority to Chinese Patent Application No. 201910101314.3, entitled "Vacuum Cleaning Device," filed on Jan. 31, 2019, the contents of which are expressly incorporated herein by reference in their entirety.

TECHNICAL FIELD

The present disclosure relates to the field of vacuum cleaner technology, and particularly to a vacuum cleaning device.

BACKGROUND

A vacuum cleaner in the prior art, such as a horizontal-type vacuum cleaner, usually includes a body and a dust cup installed on the body. For the vacuum cleaner in the prior art, it requires simultaneous operations of two hands to complete the installation or removal of the dust cup when loading and unloading the dust cup, that is, one hand presses a release button for the dust cup while the other hand takes the dust cup to remove the dust cup from the body of the horizontal-type vacuum cleaner. In such a way, it is difficult for a user to operate, and when the dust cup is removed, dust and the like on a filter easily fall off and accordingly cause a secondary contamination, which consequently leads to an adverse user experience.

SUMMARY

Specifically, the present disclosure provides a vacuum cleaning device including a body, a dust cup, and an unlocking mechanism for unlocking/locking the dust cup; the body is provided with a vacuum cleaning channel; a filter is provided in the dust cup; the unlocking mechanism is configured to have a locking state and an unlocking state; when the unlocking mechanism is in the locking state, the dust cup and the body are locked together in a sealing manner, and the vacuum cleaning channel is in communication with the filter and the dust cup such that the filter and the dust cup are in a working state; when the unlocking mechanism is in the unlocking state, the dust cup and the filter are capable of being automatically disengaged from the vacuum cleaning channel to an easy-to-take state.

Optionally, the dust cup and the filter are automatically disengaged from the vacuum cleaning channel to the easy-to-take state through a rotating support structure.

Optionally, the rotating support structure includes a support unit and a rotating unit.

Optionally, the support unit has a plug-slot structure, a plug is provided on one of the dust cup and the body, and a slot is provided on the other.

Optionally, on one inner wall of the slot are provided a plurality of wedge blocks facing the other inner wall of the slot, and the plug has an interference fit with the wedge blocks so that the plug is locked in the slot.

Optionally, the wedge blocks each have a thickness that gradually increases from bottom to top toward the other inner wall of the slot; the plurality of wedge blocks are arranged in parallel at intervals.

Optionally, the plug is provided with a positioning protrusion, and the slot is provided with a positioning groove corresponding to the positioning protrusion, such that the positioning protrusion is embedded in the positioning groove when the plug is inserted into the slot.

Optionally, the plug is of an "L" shape.

Optionally, the body is provided with a first limit plate and a second limit plate configured to limit an angle of rotation of the support unit, the first limit plate and the second limit plate are spaced from each other, such that the support unit partially extends between the first limit plate and the second limit plate.

Optionally, the support unit has a cup stand structure.

Optionally, the cup stand structure is an annular hoop structure or a tray-type structure matching a bottom portion of the dust cup.

Optionally, the rotating unit includes an elastic member capable of automatically rotating the dust cup from the working state to the easy-to-take state.

Optionally, the elastic member is a torsion spring.

Optionally, the dust cup is automatically disengaged from the vacuum cleaning channel to the easy-to-take state in a rotating mode.

Optionally, the angle of the rotation of the dust cup is between 30 and 50 degrees.

Optionally, the unlocking mechanism is a one-click unlocking device.

Optionally, the unlocking mechanism is triggered to unlock by pressing or spinning.

Optionally, the unlocking mechanism includes an unlocking key, a transmission rod and a lock catch, and when the unlocking key is triggered, triggering is transmitted to the lock catch through the transmission rod to trigger unlocking of the lock catch.

Optionally, the dust cup or the filter is provided with a locking portion matching the lock catch of the unlocking mechanism.

Optionally, the dust cup, the filter and the vacuum cleaning channel are independent of each other.

Optionally, a side wall of the dust cup is provided with an air inlet, and the air inlet is connected to the vacuum cleaning channel in a sealing manner when the dust cup is in the working state.

Optionally, the filter is provided with an air outlet, and the air outlet is connected to the vacuum cleaning channel in a sealing manner when the filter is in the working state.

Optionally, a sealing member is provided between the filter and an inner wall of the dust cup.

Optionally, the filter is detachably provided in the dust cup, and a height of the filter is not greater than that of the dust cup.

Optionally, a cushion tube is provided in the dust cup to make the filter and the vacuum cleaning channel fitted and installed together.

Optionally, a sum of a height of the cushion tube and the height of the filter is not greater than the height of the dust cup.

Optionally, a rubber ring is provided between the cushion tube and the filter.

Another vacuuming cleaning device is provided which includes a body provided with a mounting bracket and at least two filter mechanisms which are independent from each other; the body is provided with a vacuum cleaning channel, the at least two filter mechanisms are arranged up and down along the body and installed on both sides of the mounting bracket; a lower filter mechanism is provided with a dust cup and a filter placed in the dust cup; the filter and the dust cup are configured to have a working state and an easy-to-take state, the vacuum cleaning channel is in communication with the filter and the dust cup when the filter and the dust cup are in the working state; the dust cup and the filter are simultaneously disengaged from the vacuum cleaning channel when the filter and the dust cup are in the easy-to-take state.

Optionally, the mounting bracket or the body is provided with an unlocking mechanism for unlocking/locking the dust cup, and the unlocking mechanism is configured to have a locking state and an unlocking state; when the unlocking mechanism is in the locking state, the dust cup and the mounting bracket are locked together in a sealing manner, and the vacuum cleaning channel is in communication with the filter and the dust cup such that the filter and the dust cup are in the working state; when the unlocking mechanism is in the unlocking state, the dust cup and the filter are simultaneously disengaged from the vacuum cleaning channel to the easy-to-take state.

Optionally, when the unlocking mechanism is in the unlocking state, the dust cup and the filter are disengaged from the vacuum cleaning channel to the easy-to-take state through an automatic disengagement manner or a rotation manner or a clamping manner.

Optionally, the unlocking mechanism includes one of a one-click unlocking device, a rotary unlocking device, and a clamping unlocking device.

Optionally, the one-click unlocking device includes an unlocking key, a transmission rod and a lock catch, and when the unlocking key is triggered, triggering is transmitted to the lock catch through the transmission rod to unlock the lock catch.

Optionally, the unlocking key is a button trigger unlocking key or a rotary trigger unlocking key.

Optionally, the dust cup is provided with a locking portion matching the lock catch of the one-click unlocking device.

Optionally, the rotary unlocking device includes screw threads provided on the dust cup and the mounting bracket, and the dust cup is locked and unlocked through a threaded connection.

Optionally, the clamping unlocking device has an annular clamping structure or a cantilever clamping structure.

Optionally, the dust cup and the filter are automatically disengaged from the vacuum cleaning channel to the easy-to-take state by a rotating support structure.

Optionally, the rotating support structure includes a support unit and a rotating unit.

Optionally, the support unit has a cup stand structure.

Optionally, the cup stand structure is an annular hoop structure or a tray-type structure matching a bottom portion of the dust cup.

Optionally, the rotating unit includes an elastic member capable of automatically rotating the dust cup from the working state to the easy-to-take state.

Optionally, the elastic member is a torsion spring.

Optionally, the dust cup is automatically disengaged from the vacuum cleaning channel to the easy-to-take state in a rotating manner.

Optionally, an angle of rotation of the dust cup is between 30 and 50 degrees.

Optionally, a side wall of the dust cup is provided with an air inlet, and the air inlet is connected to the vacuum cleaning channel in a sealing manner when the dust cup is in the working state.

Optionally, the filter is provided with an air outlet, and the air outlet is connected to the vacuum cleaning channel in a sealing manner when the filter is in the working state.

Optionally, the filter is detachably provided in the dust cup, and a height of the filter is not greater than that of the dust cup.

Optionally, a sealing member is provided between the filter and an inner wall of the dust cup.

In the vacuum cleaning device provided by the present disclosure, the dust cup is locked or unlocked through the unlocking mechanism for unlocking/locking the dust cup. When the unlocking mechanism is in the locking state, the dust cup and the body are locked together in a sealing manner, and the vacuum cleaning channel is in communication with the filter and the dust cup such that the filter and the dust cup are in the working state; when the unlocking mechanism is in the unlocking state, the dust cup and the filter can be automatically disengaged from the vacuum cleaning channel to an easy-to-take state.

In the vacuum cleaning device provided by the present disclosure, the filter is provided in the dust cup, and the filter and the dust cup are synchronously disengaged from the vacuum cleaning channel to the easy-to-take state, thereby preventing a secondary pollution caused by dust falling from the filter.

Based on the following detailed description of specific embodiments of the present disclosure in conjunction with the accompanying drawings, those skilled in the art will better understand the above and other aspects, advantages and features of the present disclosure.

BRIEF DESCRIPTION OF THE DRAWINGS

Some specific embodiments of the present disclosure will be detailed below with reference to the accompanying drawings in an exemplary but not restrictive manner. The same reference signs in the drawings indicate the same or similar components or parts. Those skilled in the art should understand that these drawings are not definitely drawn to scale. In the drawings.

DETAILED DESCRIPTION

The embodiments of the present disclosure will be described in detail below. Examples of the embodiments are shown in the accompanying drawings in which the same or similar reference signs indicate the same or similar elements or elements having the same or similar functions. The embodiments described below with reference to the accompanying drawings are exemplary, and are intended to explain the present disclosure, but should not be construed as limiting the present disclosure.

In the description of the present disclosure, it should be appreciated that terms indicating orientations or position relationships such as "center", "longitudinal", "transverse", "length", "width", "thickness", "upper", "lower", "front", "back", "left", "right", "vertical", "horizontal", "top", "bottom", "inner", "outer", "clockwise", "counterclockwise" and so on are based on the orientations or position relationships shown in the accompanying drawings, which are used only to facilitate the description of the present disclosure and simplify the description, rather than indicating or implying that the device or element(s) referred to needs to have a specific orientation, be constructed and operated in a specific orientation, and thus the terms are not understood as limiting the present disclosure.

In the present disclosure, unless otherwise expressly specified and defined, that a first feature is "on" or "under" a second feature may include the first feature directly contacts the second feature, or may include the first feature does not directly contact the second feature but through other features therebetween. Moreover, that the first feature is "over" or "above" the second feature includes the first feature is directly above and obliquely above the second feature, or simply means that a level height of the first feature is higher than that of the second feature. That the first feature is "below" the second feature includes the first feature directly below and obliquely below the second feature, or simply means that the level height of the first feature is less than that of the second feature.

Figure 1:
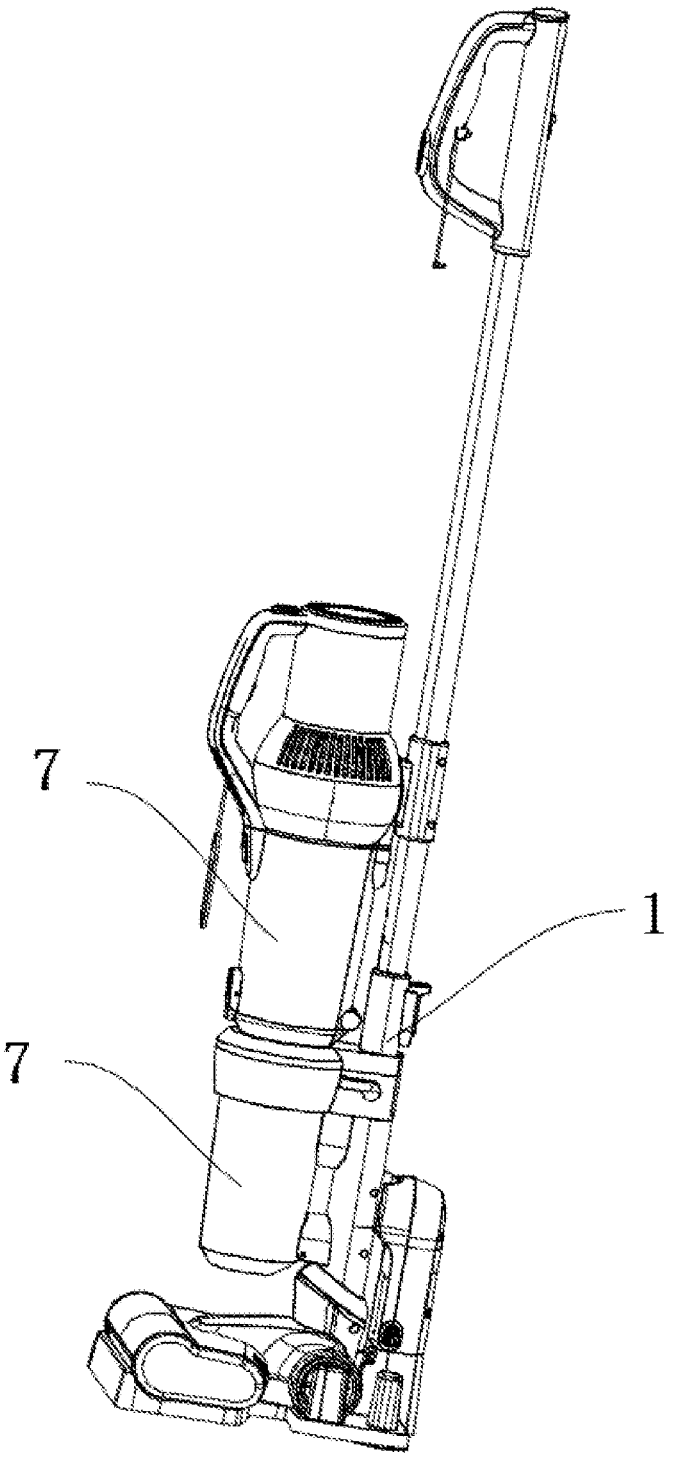
FIG. 1 is a schematic diagram illustrating an overall structure of a vacuum cleaning device according to an embodiment of the present disclosure.
Figure 2:
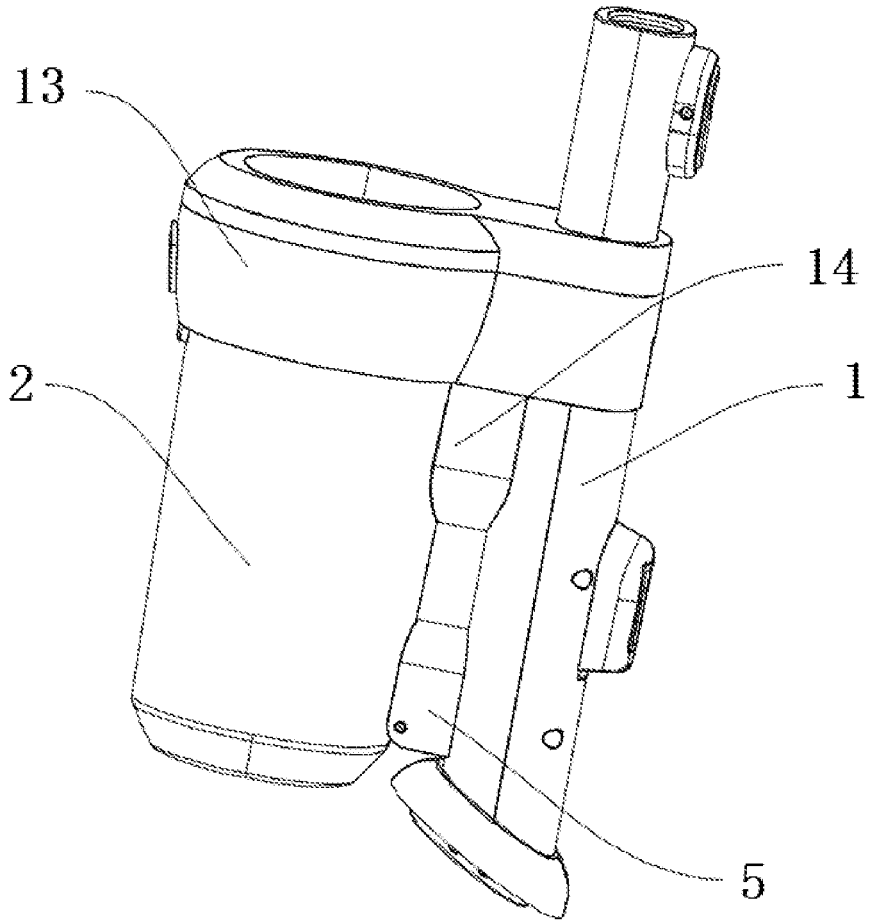
FIG. 2 is a schematic structure diagram of a dust cup and a filter of a vacuum cleaning device according to an embodiment of the present disclosure.
Figure 3:
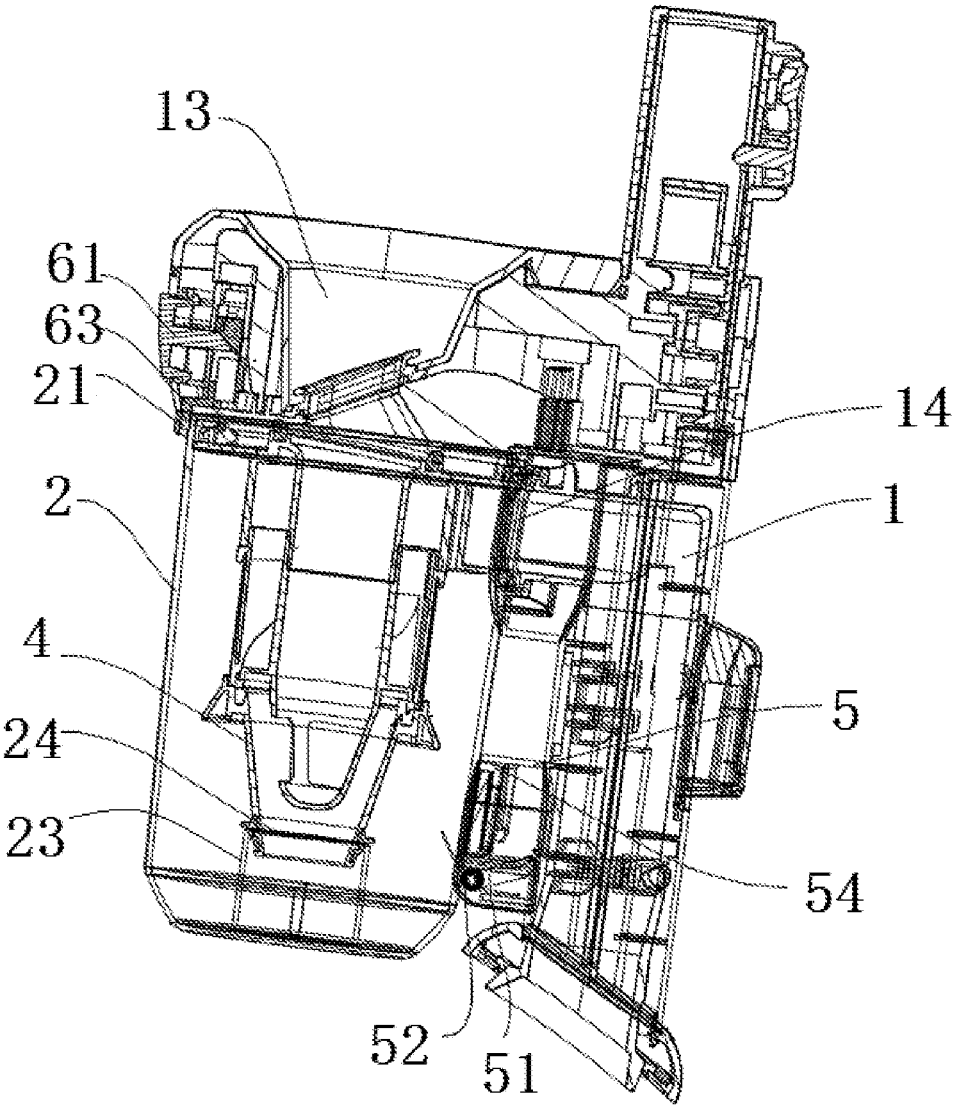
FIG. 3 is a schematic cross-sectional structure diagram of the dust cup and filter shown in FIG. 2.
Figure 4:
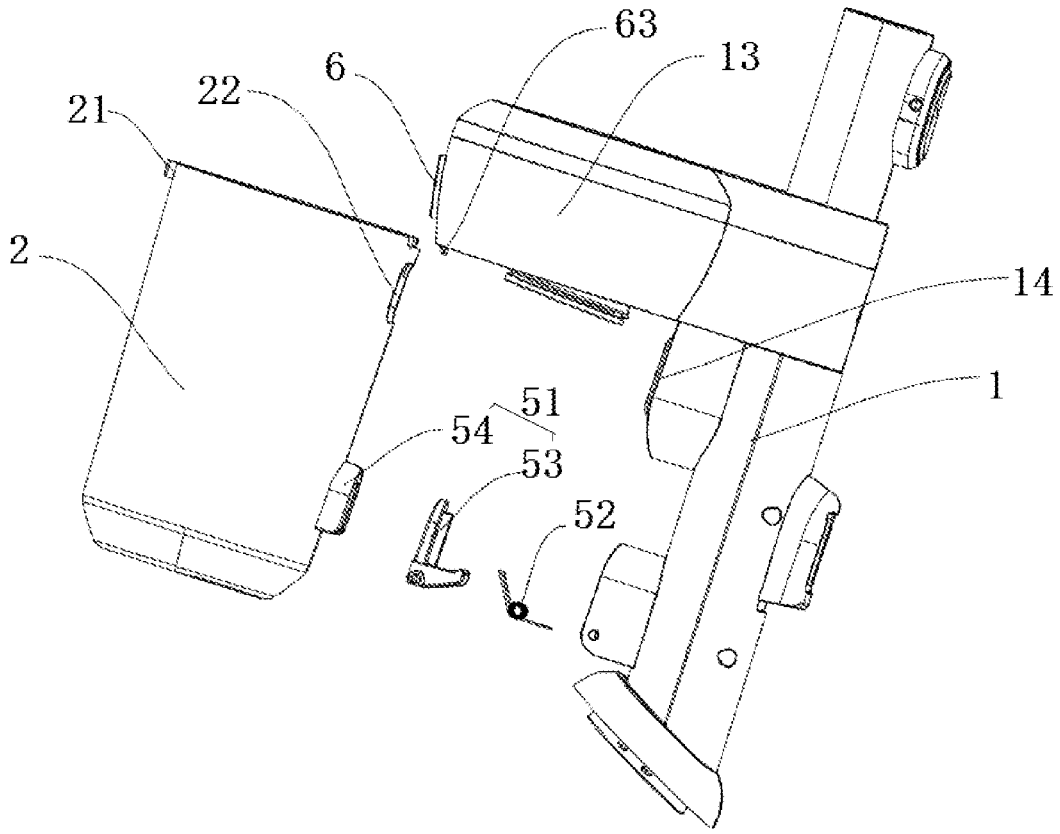
FIG. 4 is a schematic exploded view of the dust cup and filter shown in FIG. 2.

FIG. 1 is a schematic diagram illustrating an overall structure of a vacuum cleaning device according to the present disclosure. FIG. 2 is a schematic structure diagram of a dust cup 2 and a filter 4 of a vacuum cleaning device according to the present disclosure. FIG. 3 is a schematic cross-sectional structure diagram of the dust cup 2 and the filter 4 shown in FIG. 2. FIG. 4 is a schematic exploded view of the dust cup 2 and the filter 4 shown in FIG. 2. Hereinafter, a vacuum cleaning device provided by the present disclosure will be described in detail with reference to FIGS. 1 to 4. Specifically, a vacuum cleaning device provided by the present disclosure generally includes a body 1, a dust cup 2 and an unlocking mechanism 3 for unlocking/locking the dust cup 2. The body 1 includes: a cleaning head which is located at a lower portion of the vacuum cleaning device and is configured to fit to a surface of an object for vacuuming, a main body, and an armrest portion. A vacuum cleaning channel is provided inside the body 1. The vacuum cleaning channel passes through the main body and the dust cup 2, with its one end connected to the cleaning head and the other end connected to a power unit. A filter 4 is provided in the dust cup 2. The unlocking mechanism 3 is configured to have a locking state and an unlocking state. When the unlocking mechanism 3 is in the locking state, the dust cup 2 and the body 1 are locked in a sealing manner, and the vacuum cleaning channel is in communication with the filter 4 and the dust cup 2 such that the filter 4 and the dust cup 2 are in a working state, that is, the filter 4 and the dust cup 2 are sealed with the body 1; the dust cup 2, the filter 4 and the vacuum cleaning channel are independent of each other; at the same time, interior space of the filter 4 and the dust cup 2 forms a portion of the vacuum cleaning channel, such that the sealed channel is completely sealed so as to perform vacuuming and other tasks. When the unlocking mechanism 3 is in the unlocking state, the dust cup 2 and the filter 4 can be automatically disengaged from the vacuum cleaning channel to an easy-to-take state, that is, the dust cup 2 and the filter 4 are separated from the vacuum cleaning channel in the body 1, such that the vacuum cleaning channel is disconnected, and then the dust cup 2 and the filter 4 can be easily taken away for cleaning. In this case, the dust cup 2 and the filter 4 can be taken synchronously, and the secondary pollution caused by the dust falling from the filter 4 can be prevented.

Figure 5:
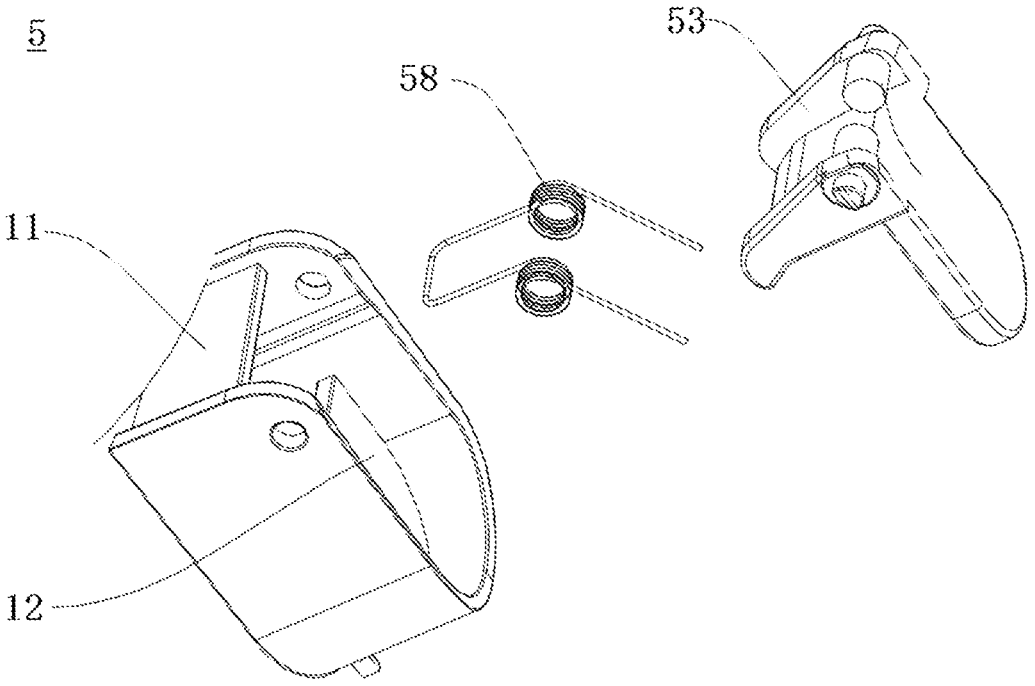
FIG. 5 is a schematic exploded view of a rotating support structure according to an embodiment of the present disclosure.
Figure 6:
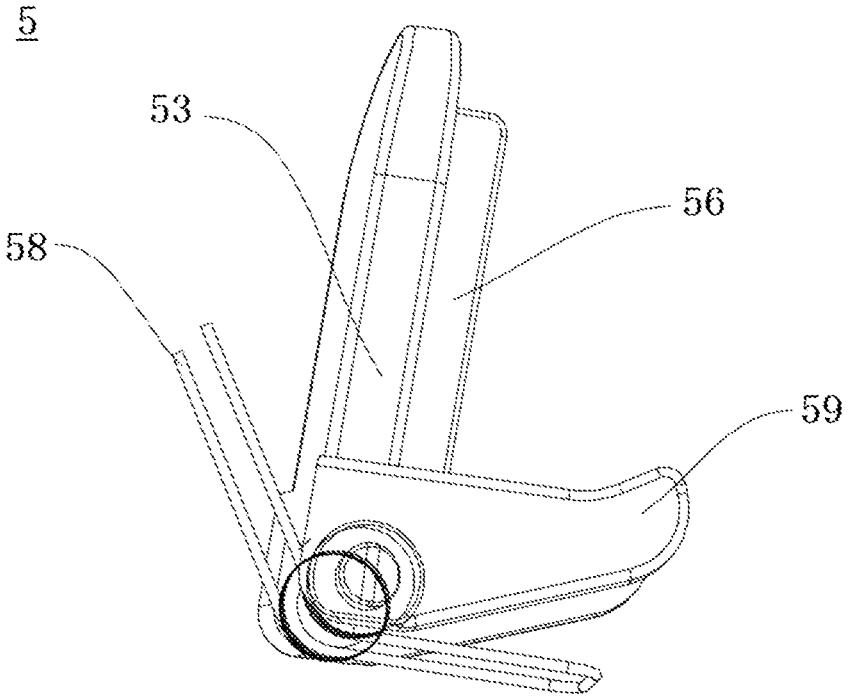
FIG. 6 is a schematic structure diagram illustrating the rotating support structure shown in FIG. 5.

In a specific embodiment, the dust cup 2 and the filter 4 can be automatically disengaged from the vacuum cleaning channel through a rotating support structure 5 so as to be in the easy-to-take state. The rotating support structure 5 includes a support unit 51 and a rotating unit 52. The support unit 51 is configured to support the dust cup 2 or the body 1, and the rotating unit 52 is configured to enable the dust cup 2 to rotate at a predetermined angle to disengage from the vacuum cleaning channel after the unlocking mechanism 3 is unlocked so that the dust cup 2 can be in the easy-to-take state. As shown in FIGS. 5 and 6, in an alternative embodiment, the support unit 51 is a plug-slot structure. A plug 53 is provided on one of the dust cup 2 and the body 1, and the slot 54 is provided on the other. The support unit 51 only needs to be able to implement a connection between the dust cup 2 and the body 1.

From the above embodiment, one aspect of the present disclosure is to provide a vacuum cleaning device to address the technical problem of secondary pollution caused by dust falling when the dust cup is removed.

Figure 7:
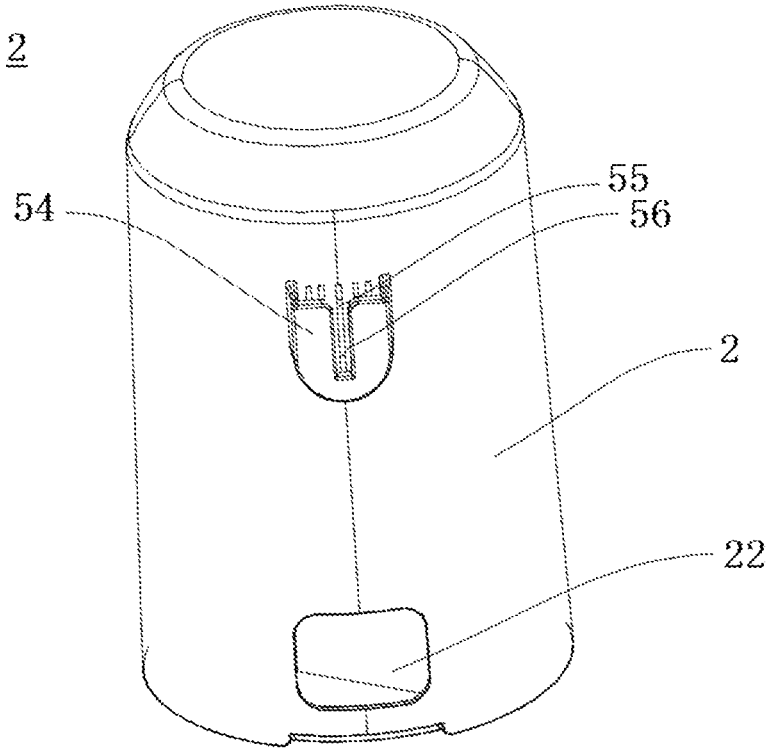
FIG. 7 is a schematic structure diagram of the dust cup shown in FIG. 2.

As shown in FIG. 7, the slot 54 is provided on a side wall of the dust cup 2. On one inner wall of the slot 54 are provided a plurality of wedge blocks 55 facing the other inner wall of the slot 54. The plug 53 has an interference fit with the wedge blocks 55 such that the plug 53 is locked in the slot 54. The plurality of wedge blocks 55 are arranged in parallel at intervals. The wedge blocks 55 each have a thickness that gradually increases from bottom to top toward the other inner wall of the slot 54, so that the connection of the plug 53 and the slot 54 is firmer and more stable. The plug 53 is provided with a positioning protrusion 56. The slot 54 is provided with a positioning groove 57 corresponding to the positioning protrusion 56 such that when the plug 53 is inserted into the slot 54, the positioning protrusion 56 can be embedded into the positioning groove 57 to further enhance the firmness and stability of the connection of the plug and the slot.

Figure 11:
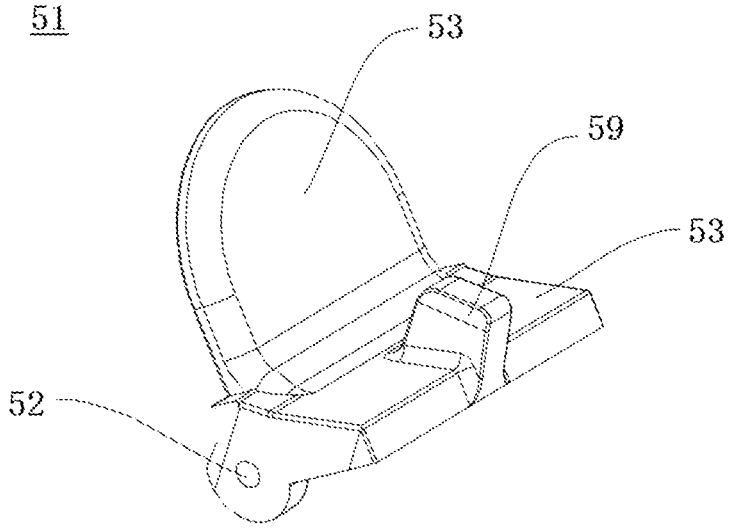
FIG. 11 is a schematic structure diagram of the rotating support structure shown in FIG. 8.

Further, as shown in FIG. 5, the plug 53 is of an "L" shape. The body 1 is provided with a first limit plate 11 and a second limit plate 12 configured to limit an angle of rotation of the support unit 51. The first limit plate 11 and the second limit plate are spaced from each other such that the support unit 51 partially extends between the first limit plate 11 and the second limit plate. As shown in FIG. 6 and FIG. 11, the support unit 51 is further provided with a limit protrusion 59. The limit protrusion 59 can cooperate with the first limit plate 11 and the second limit plate to limit the angle of rotation of the support unit 51 such that the angle of rotation of the support unit 51 is between 30 degrees and 50 degrees.

Optionally, a rotating shaft is provided on the support unit 51, and an elastic member 58 is provided on the rotating shaft. The elastic member may be a torsion spring or the like. When the dust cup is in the working state, the elastic member 58 is in a compressed and stressed state, and an expansion force of the elastic member 58 is applied between the dust cup 2 and the body 1. When the dust cup 2 is unlocked, under the action of the expansion force of the elastic member 58, the dust cup 2 automatically rotates away from the body 1. At this time, the elastic member 58 is in a freely stretched and unstressed state, so that the dust cup 2 and the filter 4 are automatically disengaged from the vacuum cleaning channel to the easy-to-take state.

From the above embodiment, another aspect of the present disclosure is to provide a vacuum cleaning device to address the technical problem of difficulty in taking and placing the dust cup in the prior art, and free hands at the same time, thereby improving actual experiences of users.

In another specific embodiment, the support unit 51 has a cup stand structure. The cup stand structure can be an annular hoop structure or a tray-type structure matching a bottom portion of the dust cup 2. In the annular hoop structure, the dust cup 2 has a cylindrical shape with an upper diameter larger than a lower diameter, so that the dust cup 2 can match the annular hoop to achieve fixation thereof. In the tray-type structure, there is a groove adapted to the bottom portion of the dust cup 2 for placing and fixing the dust cup 2. It should be noted that the support unit 51 is not limited to the plug-slot structure or the cup stand structure described above, and may also be other structures that can be used for supporting and fixing the dust cup 2, as long as connection and fixation of the dust cup 2 can be achieved.

The rotating unit 52 includes an elastic member 58 which can automatically rotate the dust cup 2 from the working state to the easy-to-take state. The elastic member 58 may be a torsion spring, or a spring with one end connected to the dust cup 2 and the other end connected to the body 1, and the like. It should be noted that the elastic member 58 functions to enable the dust cup 2 to automatically rotate to the easy-to-take state after the dust cup 2 is unlocked. Even if the elastic member 58 is not provided, the rotating unit 52 can also enable the dust cup 2 to rotate to the easy-to-take state after the dust cup 2 is unlocked, for example, the dust cup 2 can be rotated under an action of gravity or manually, as long as the dust cup 2 can be pivotally disengaged/automatically disengaged from the vacuum cleaning channel to the easy-to-take state.

Figure 13:
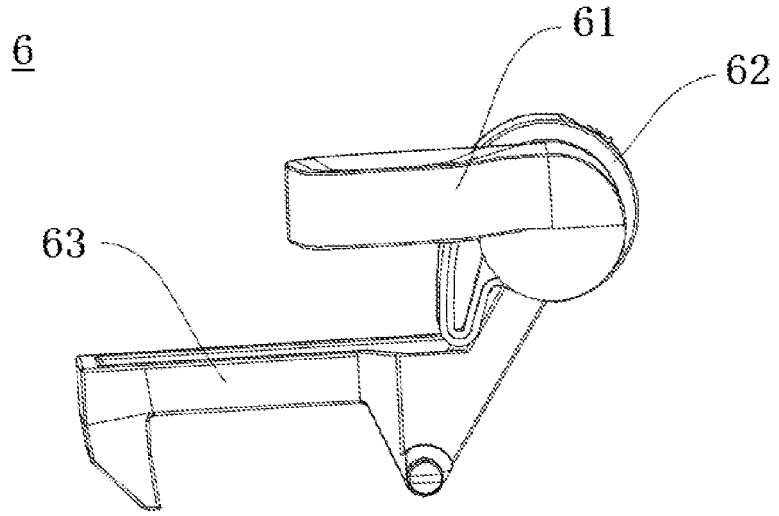
FIG. 13 is a schematic structure diagram of an unlocking mechanism shown in FIG. 8.

The unlocking mechanism 3 is a one-click unlocking device 6. The unlocking mechanism 3 can be unlocked by pressing or spinning. As shown in FIGS. 3 and 4, in a specific embodiment, the one-click unlocking device 6 is unlocked by pressing. The unlocking mechanism 3 includes an unlocking key 61 and a lock catch 63. When the unlocking key 61 is pressed, the lock catch 63 is displaced to trigger the unlocking of the lock catch 63. The dust cup 2 is provided with a lock portion 21 matching the lock catch 63 of the unlocking mechanism 3. As shown in FIG. 13, in another specific embodiment, the one-click unlocking device 6 used is unlocked by spinning. The unlocking mechanism 3 includes an unlocking key 61, a transmission rod 62 and a lock catch 63. When the unlocking key 61 is triggered, the triggering is transmitted to the lock catch 63 through the transmission rod 62 to unlock of the lock catch 63. The filter 4 is provided with a lock portion 41 matching the lock catch 63 of the unlocking mechanism 3. The lock portion can be provided on the dust cup 2 or on the filter 4. Preferably, the lock portion 41 is provided on the filter 4, so that the lock portion 41 can also be used as a fool-proofing design required when the filter 4 is placed into the dust cup 2, for example, a notch is provided in the edge of the mouth of the dust cup 2 to simultaneously match the lock portion 41.

Figure 8:
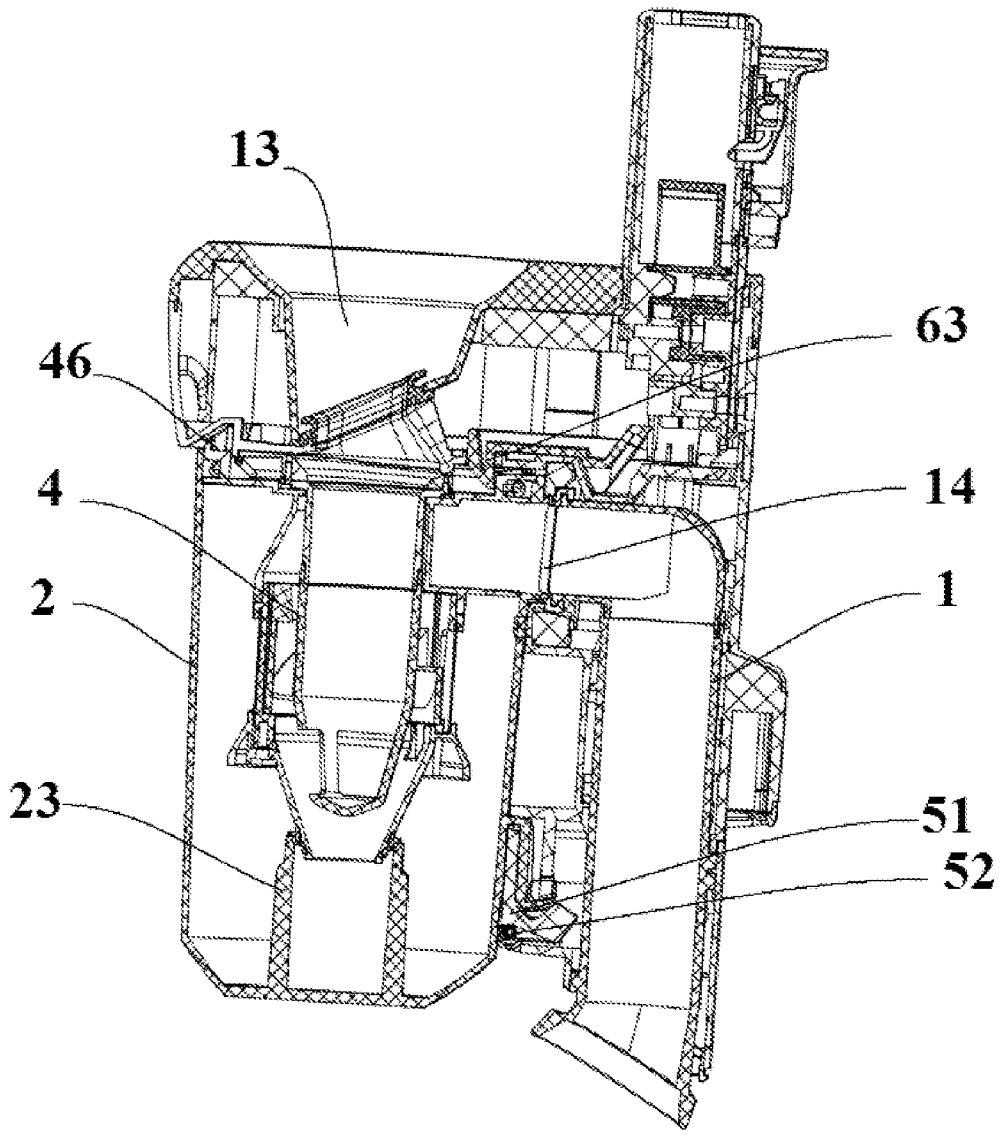
FIG. 8 is a schematic cross-sectional structure diagram of a dust cup and a filter of a vacuum cleaning device according to another embodiment of the present disclosure.
Figure 9:
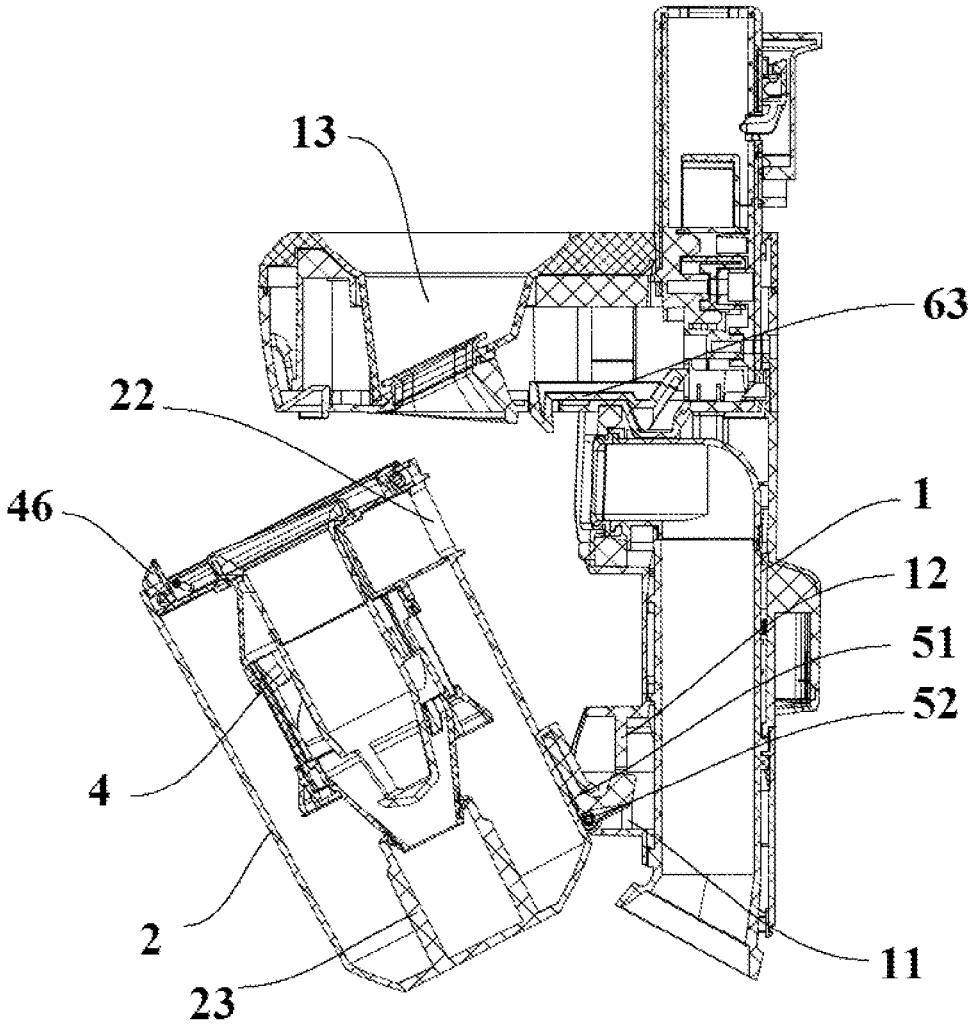
FIG. 9 is a schematic cross-sectional structure diagram of the dust cup and filter shown in FIG. 8 when they are unlocked and are in an easy-to-take state.
Figure 10:
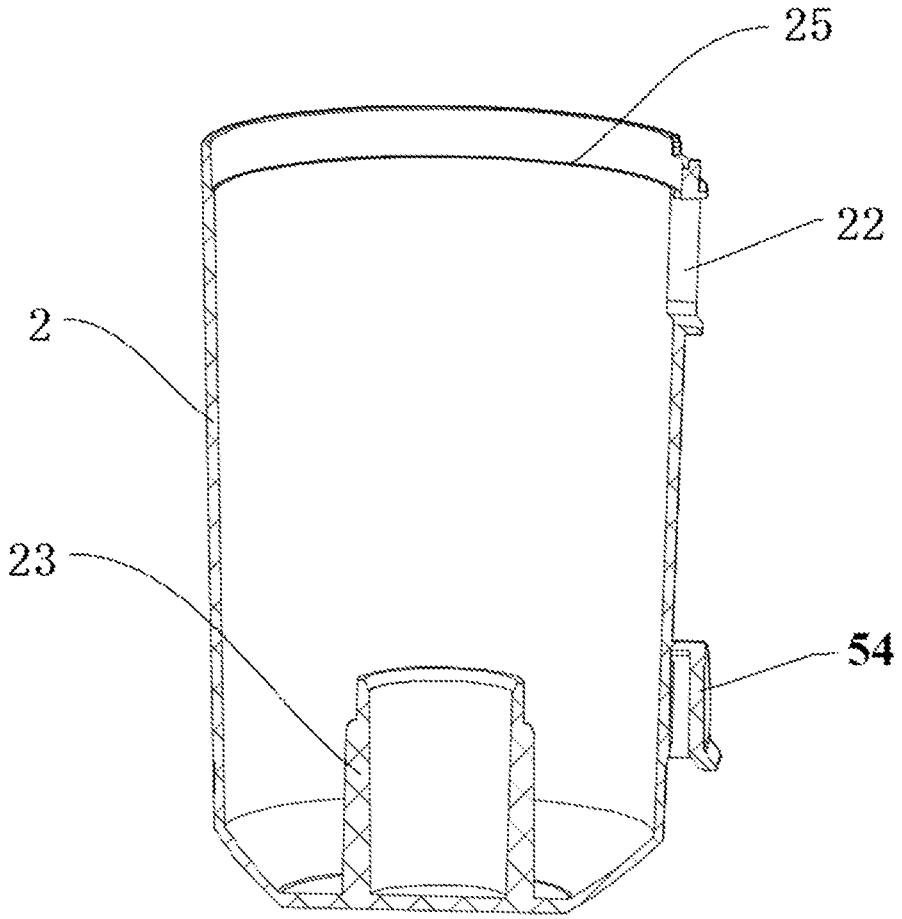
FIG. 10 is a schematic cross-sectional structure diagram of the dust cup shown in FIG. 8.

As shown in FIGS. 8, 9 and 10, structures of a dust cup and a filter of a vacuum cleaning device in another embodiment of the present disclosure are illustrated. The one-click unlocking device 6 is unlocked by spinning. FIG. 9 is a schematic cross-sectional structure diagram when the dust cup 2 and the filter 4 are unlocked and are in an easy-to-take state. At this time, the dust cup 2 and the filter 4 are synchronously rotated to disengage from the vacuum cleaning channel of the body 2 at a predetermined angle, so as to facilitate to take and clean the dust cup 2 or the filter 4.

Figure 12:
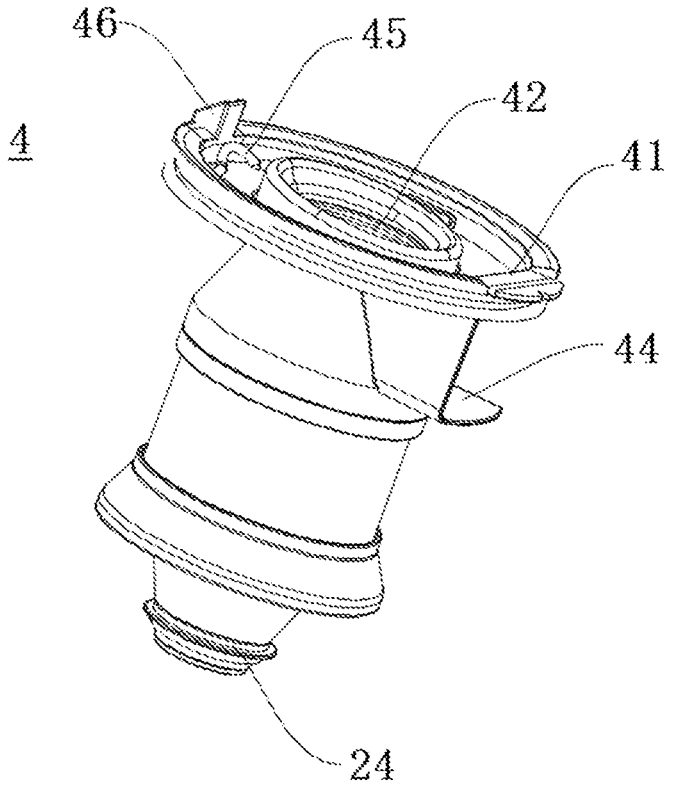
FIG. 12 is a schematic structure diagram of the filter shown in FIG. 8.

As shown in FIGS. 4 and 7, the dust cup 2 is provided with an air inlet 22 in a side wall thereof, and the air inlet 22 is connected to the vacuum cleaning channel in a sealing manner when the dust cup 2 is in the working state, that is, when the unlocking mechanism 3 is in the locking state, the air inlet 22 is fitted to a matching portion 14 of the air inlet 22 of the body 1 in a sealing manner. As shown in FIG. 12, the filter 4 is provided with an air outlet 42. When the filter 4 is in the working state, the air outlet 42 is connected to the vacuum cleaning channel in a sealing manner, that is, when the unlocking mechanism 3 is in the locking state, the air outlet 42 is fitted to the vacuum cleaning channel of the body 1 in the sealing manner. Accordingly, the interior space of the filter 4 and the dust cup 2 forms a portion of the vacuum cleaning channel, such that the sealed channel is completely sealed so as to perform vacuuming and other tasks. When the unlocking mechanism 3 is in the unlocking state, the filter 4 and the dust cup 2 are disengaged from the vacuum cleaning channel, so that the filter 4 and the dust cup 2, and the vacuum cleaning channel are independent of each other, so as to facilitate to take and clean the filter 4 and the dust cup 2. In a specific embodiment, a sealing member 43 is provided between the filter 4 and an inner wall of the dust cup 2. An upper portion of the inner wall of the dust cup 2 is provided with a circular step 25, and the filter 4 rests on the circular step 25 by its upper portion. A sealing is formed between the upper portion of the filter 4 and the inner wall of the dust cup 2 by means of the sealing member 43.

The filter 4 is detachably arranged in the dust cup 2, and a height of the filter 4 is not greater than a height of the dust cup 2, such that when the unlocking mechanism 3 is in the unlocking state, the dust cup 2 and the filter 4 can be synchronously and automatically disengaged from the vacuum cleaning channel. As shown in FIG. 3, optionally, a cushion tube 23 configured to enable the filter 4 and the vacuum cleaning channel to be fitted and installed together is provided in the dust cup 2. A sum of a height of the cushion tube 23 and the height of the filter 4 is not greater than the height of the dust cup 2, so that when the unlocking mechanism 3 is in the unlocking state, the dust cup 2 and the filter 4 can be synchronously and automatically disengaged from the vacuum cleaning channel. A rubber ring 24 is provided between the cushion tube 23 and the filter 4 to make the filter 4 and the vacuum cleaning channel of the body 1 fit more closely.

As shown in FIG. 12, a pull ring 45 is also provided on the filter 4 to facilitate the removal of the filter 4. The filter 4 is also provided with a baffle 44. The baffle 44 is located at a place where the filter 4 is matched with the air inlet of the dust cup 2, so that after entering the dust cup 2, airflow flows along a whirlwind duct between the filter 4 and the inner wall of the dust cup 2. The filter 4 is also provided with a positioning block 46 which is configured to assist in positioning an installation position of the filter 4 so as to make the filter 4 match the unlocking mechanism 3 to implement firmer and more stable installation.

As shown in FIGS. 8 to 13, a vacuum cleaning device provided by the present disclosure includes a body 1 which is provided with a mounting bracket 13 and at least two filter mechanisms 77 independent of each other. The body 1 is provided with a vacuum cleaning channel. The at least two filter mechanisms 77 which are independent from each other are arranged up and down the body 1 and installed on both sides of the mounting bracket 13. The lower filter mechanism 77 is provided with a dust cup 2 and a filter 4 placed in the dust cup 2. The filter 4 and the dust cup 2 are configured to have a working state and an easy-to-take state. When the filter 4 and the dust cup 2 are in the working state, the vacuum cleaning channel is in communication with the filter 4 and the dust cup 2, that is, the filter 4 and the dust cup 2 are sealed with the body 1, the dust cup 2, the filter 4 and the vacuum cleaning channel are independent of each other, and at the same time, the interior space of the filter 4 and the dust cup 2 forms a portion of the vacuum cleaning channel, such that the sealed channel is completely sealed so as to perform vacuuming and other tasks. When the filter 4 and the dust cup 2 are in the easy-to-take state, the dust cup 2 and the filter 4 are simultaneously disengaged from the vacuum cleaning channel, that is, the dust cup 2 and the filter 4 are separated from the vacuum cleaning channel on the body 1, such that the vacuum cleaning channel is disconnected, and accordingly, the dust cup 2 and the filter 4 can be easily taken for cleaning. Thus, the dust cup 2 and the filter 4 can be taken synchronously, and the secondary pollution caused by the dust falling from the filter 4 can be prevented.

In a specific embodiment, the mounting bracket 13 or the body 1 is provided with an unlocking mechanism 3 for unlocking/locking the dust cup 2. The unlocking mechanism 3 is configured to have a locking state and an unlocking state. When the unlocking mechanism 3 is in the locking state, the dust cup 2 and the mounting bracket 13 are locked together in a sealing manner, and the vacuum cleaning channel is in communication with the filter 4 and the dust cup 2 such that the filter 4 and the dust cup 2 are in the working state. When the unlocking mechanism 3 is in the unlocking state, the dust cup 2 and the filter 4 can be simultaneously and synchronously disengaged from the vacuum cleaning channel to the easy-to-take state.

In a specific embodiment, at least two filter mechanisms 7 which are independent from each other are arranged up and down along the body 1, and the lower filter mechanism 7 is provided with a dust cup 2 and a filter 4. When the unlocking mechanism 3 is in the unlocking state, the dust cup 2 and the filter 4 are disengaged from the vacuum cleaning channel in an automatic disengagement manner or a rotation manner or a clamping manner to the easy-to-take state.

In a specific embodiment, the unlocking mechanism 3 includes one of a one-click unlocking device 6, a rotary unlocking device, and a clamping unlocking device. In addition, the unlocking mechanism 3 can also be other unlocking mechanisms 3 well known to those skilled in the art, as long as the unlocking mechanism can implement the locking/unlocking of the dust cup 2.

As mentioned above, the one-click unlocking device 6 includes an unlocking key 61, a transmission rod 62 and a lock catch 63. When the unlocking key 61 is triggered, the triggering is transmitted to the lock catch 63 through the transmission rod 62 to unlock the lock catch 63. The unlocking key 61 is a button trigger unlocking key 61 or a rotary trigger unlocking key 61. The dust cup 2 is provided with a locking portion matching the lock catch 63 of the one-click unlocking device 6.

Optionally, the rotary unlocking device includes screw threads provided on the dust cup 2 and the body 1, and the locking and unlocking of the dust cup 2 can be implemented through a threaded connection.

The clamping unlocking device includes an annular clamping structure and a cantilever clamping structure. The annular clamping structure includes a clamping ring with predetermined elasticity and a joint matching the clamping ring. The joint can be inserted into the clamping ring to implement the clamping; the clamping ring is provided on one of the dust cup 2 and the body 1, and the joint is provided on the other of the dust cup 2 and the body 1. The cantilever clamping device includes a hook and a groove matching the hook. The hook can be clamped into the groove to implement the clamping; the hook is provided on one of the dust cup 2 and the body 1, and the groove is provided on the other of the dust cup 2 and the body 1.

In a specific embodiment, a vacuum cleaning device having multi-stage filter mechanisms 7 which are independent from each other is provided. In the vacuum cleaning device, the connection between the dust cup 2 and the body 1, and the installation of the dust cup 2 and the filter 4, and the working principle thereof are the same as those in the previous embodiments. Similarly, the dust cup 2 and the filter 4 can be automatically disengaged from the vacuum cleaning channel through a rotating support structure 5 to the easy-to-take state, which will not be repeated here.

In the vacuum cleaning device provided by the present disclosure, through the provided unlocking mechanism 3 for unlocking/locking the dust cup 2 to lock/unlock the dust cup 2, when the unlocking mechanism 3 is in the locking state, the dust cup 2 and the body 1 are locked together in a sealing manner, and the vacuum cleaning channel is in communication with the filter 4 and the dust cup 2 such that the filter 4 and the dust cup 2 are in the working state; when the unlocking mechanism 3 is in the unlocking state, the dust cup 2 and the filter 4 can be automatically disengaged from the vacuum cleaning channel to the easy-to-take state.

In the vacuum cleaning device provided by the present disclosure, the filter 4 is provided in the dust cup 2, and the filter 4 and the dust cup 2 are synchronously disengaged from the vacuum cleaning channel to the easy-to-take state, thereby preventing a secondary pollution caused by the dust falling from the filter 4.

In the vacuum cleaning device provided by the present disclosure, the dust cup 2 is taken and placed at an angle. After unlocked, the dust cup 2 can be taken and placed at any time without holding the dust cup in hand. Further, the structure of the vacuum cleaning device is simple and easy to understand, and the vacuum cleaning device is convenient and efficient for the user to use.

So far, those skilled in the art should appreciate that although a number of exemplary embodiments of the present disclosure have been illustrated and described in detail herein, many other variations or modifications that conform to the principle of the present disclosure can still be directly determined or derived according to the present disclosure without departing from the spirit and scope of the present disclosure. Therefore, the scope of the present disclosure should be understood and deemed to cover all the variations or modifications.

What is claimed is:

1. A vacuum cleaning device, comprising a body, a dust cup, and an unlocking mechanism for unlocking or locking the dust cup, the body being provided with a vacuum cleaning channel, a filter being provided in the dust cup; the unlocking mechanism being configured to have a locking state and an unlocking state; when the unlocking mechanism is in the locking state, the dust cup and the body being locked together in a sealing manner, and the vacuum cleaning channel being in communication with the filter and the dust cup such that the filter and the dust cup are in a working state; wherein, when the unlocking mechanism is in the unlocking state, the dust cup and the filter are capable of being automatically disengaged from the vacuum cleaning channel to an easy-to-take state;

wherein the unlocking mechanism comprises an unlocking key and a lock catch configured to displace and trigger unlocking of the lock catch when the unlocking key is pressed;

wherein the dust cup and the filter are automatically and synchronously disengaged from the vacuum cleaning channel to the easy-to-take state through a rotating support structure wherein the rotating support structure includes a support unit and a rotating unit; and wherein the support structure has a plug-slot structure, a plug or a slot is pivotability provided on the body and the other is provided on the dust cup.

2. The vacuum cleaning device according to claim 1, wherein;

on one inner wall of the slot are provided a plurality of wedge blocks facing the other inner wall of the slot, and the plug has an interference fit with the wedge blocks so that the plug is locked in the slot;

the wedge blocks each have a thickness that gradually increases from bottom to top toward the other inner wall of the slot; the plurality of wedge blocks are arranged in parallel at intervals;

the plug is provided with a positioning protrusion, and the slot is provided with a positioning groove corresponding to the positioning protrusion, such that the positioning protrusion is embedded in the positioning groove when the plug is inserted into the slot;

the plug is of an "L" shape.

3. The vacuum cleaning device according to claim 2, wherein the body is provided with a first limit plate and a second limit plate configured to limit an angle of rotation of the support unit, the first limit plate and the second limit plate are spaced from each other, such that the support unit partially extends between the first limit plate and the second limit plate.

4. The vacuum cleaning device according to claim 2, wherein the support unit has a cup stand structure;

the cup stand structure is an annular hoop structure or has a tray-type structure matching a bottom portion of the dust cups wherein the annular hoop structure comprises an annular hoop matching a diameter of the dust cup;

wherein the tray-type structure is provided with a groove adapted to the bottom portion of the dust cup.

5. The vacuum cleaning device according to claim 2, wherein the rotating unit includes an elastic member capable of automatically rotating the dust cup from the working state to the easy-to-take state;

the elastic member is a torsion spring.

6. The vacuum cleaning device according to claim 1, wherein the dust cup is automatically disengaged from the vacuum cleaning channel to the easy-to-take state in a rotating manner;

an angle of the rotation of the dust cup is between 30 and 50 degrees.

7. The vacuum cleaning device according to claim 1, wherein the unlocking mechanism is a one-click unlocking device;

the unlocking mechanism is triggered to unlock by pressing or spinning;

the unlocking mechanism comprises an unlocking key, a transmission rod and a lock catch, and when the unlocking key is triggered, triggering is transmitted to the lock catch through the transmission rod to trigger unlocking of the lock catch;

the dust cup or the filter is provided with a locking portion matching the lock catch of the unlocking mechanism.

8. The vacuum cleaning device according to claim 1, wherein the dust cup, the filter and the vacuum cleaning channel are independent of each other.

9. The vacuum cleaning device according to claim 1, wherein a side wall of the dust cup is provided with an air inlet, the air inlet is connected to the vacuum cleaning channel in a sealing manner when the dust cup is in the working state.

10. The vacuum cleaning device according to claim 1, wherein the filter is provided with an air outlet, and the air outlet is connected to the vacuum cleaning channel in a sealing manner when the filter is in the working state.

11. The vacuum cleaning device according to claim 1, wherein a sealing member is provided between the filter and an inner wall of the dust cup.

12. The vacuum cleaning device according to claim 1, wherein the filter is detachably provided in the dust cup, and a height of the filter is not greater than that of the dust cup.

13. The vacuum cleaning device according to claim 1, wherein a cushion tube is provided in the dust cup to make the filter and the vacuum cleaning channel fitted and installed together;

a sum of a height of the cushion tube and a height of the filter is not greater than the height of the dust cup.

14. A vacuuming cleaning device, comprising a body provided with a mounting bracket and at least two filter mechanisms which are independent from each other, the body being provided with a vacuum cleaning channel, wherein the at least two filter mechanisms are arranged up and down along the body and installed on both sides of the mounting bracket, a lower filter mechanism is provided with a dust cup and a filter placed in the dust cup; the filter and the dust cup are configured to have a working state and an easy-to-take state; the vacuum cleaning channel is in communication with the filter and the dust cup when the filter and the dust cup are in the working state; the dust cup and the filter are simultaneously disengaged from the vacuum cleaning channel when the filter and the dust cup are in the easy-to-take state;

wherein the dust cup and the filter are automatically and synchronously disengaged from the vacuum cleaning channel to the easy-to-take state through a rotating support structure wherein the mounting bracket or the body is provided with an unlocking mechanism for unlocking or locking the dust cup; wherein the rotating support structure includes a support unit and a rotating unit; and wherein the support structure has a plug-slot structure, a plug or a slot is pivotability provided on the body and the other is provided on the dust cup.

15. The vacuum cleaning device according to claim 14, and the unlocking mechanism is configured to have a locking state and an unlocking state; when the unlocking mechanism is in the locking state, the dust cup and the mounting bracket are locked together in a sealing manner, and the vacuum cleaning channel is in communication with the filter and the dust cup such that the filter and the dust cup are in the working state; when the unlocking mechanism is in the unlocking state, the dust cup and the filter are simultaneously disengaged from the vacuum cleaning channel to the easy-to-take state;

when the unlocking mechanism is in the unlocking state, the dust cup and the filter are disengaged from the vacuum cleaning channel to the easy-to-take state through an automatic disengagement manner or a rotation manner or a clamping manner;

the unlocking mechanism comprises one of a one-click unlocking device, a rotary unlocking device, and a clamping unlocking device;

the one-click unlocking device comprises an unlocking key, a transmission rod and a lock catch, and when the unlocking key is triggered, triggering is transmitted to the lock catch through the transmission rod to unlock the lock catch;

the unlocking key is a button trigger unlocking key or a rotary trigger unlocking key;

the dust cup is provided with a locking portion matching the lock catch of the one-click unlocking device;

the rotary unlocking device comprises screw threads provided on the dust cup and the mounting bracket, and the dust cup is locked and unlocked through a threaded connection;

the clamping unlocking device has an annular clamping structure or a cantilever clamping structure;

wherein the unlocking mechanism comprises an unlocking key and a lock catch configured to displace and trigger unlocking of the lock catch when the unlocking key is pressed.

16. The vacuum cleaning device according to claim 14, wherein the support unit has a cut stand structure; the cup stand structure is an annular hoop structure or a tray-type structure matching a bottom portion of the dust cup.

17. The vacuum cleaning device according to claim 16, wherein the rotating unit comprises an elastic member capable of automatically rotating the dust cup from the working state to the easy-to-take state;

the elastic member is a torsion spring.

18. The vacuum cleaning device according to claim 14, wherein the dust cup is automatically disengaged from the vacuum cleaning channel to the easy-to-take state in a rotating mode;

an angle of rotation of the dust cup is between 30 and 50 degrees.

19. The vacuum cleaning device according to claim 14, wherein a side wall of the dust cup is provided with an air inlet, and the air inlet is connected to the vacuum cleaning channel in a sealing manner when the dust cup is in the working state;

the filter is provided with an air outlet, and the air outlet is connected to the vacuum cleaning channel in a sealing manner when the filter is in the working state.

20. The vacuum cleaning device according to claim 14, wherein the filter is detachably provided in the dust cup, and a height of the filter is not greater than that of the dust cup;

a sealing member is provided between the filter and an inner wall of the dust cup.

* * * * *